US005268237A

United States Patent [19]

Tanaka et al.

[11] Patent Number: 5,268,237

[45] Date of Patent: Dec. 7, 1993

[54] COMPOSITE ELECTRICAL CONTACT

[75] Inventors: Seiichi Tanaka, Tokyo; Shigeru Tabei, Machida, both of Japan

[73] Assignee: Chugai Denki Kogyo K.K., Japan

[21] Appl. No.: 952,570

[22] Filed: Sep. 28, 1992

[30] Foreign Application Priority Data

Oct. 28, 1991 [JP] Japan ..... 3-347579

[51] Int. Cl.[5] ..... H01H 1/02

[52] U.S. Cl. ..... 428/673; 428/674; 428/929; 200/267

[58] Field of Search ..... 428/929, 669, 671, 673, 428/674; 200/266, 267, 268, 269

[56] References Cited

U.S. PATENT DOCUMENTS

| | | | |
|---|---|---|---|
| 980,420 | 1/1911 | Hulfish | 200/267 |
| 1,236,523 | 8/1917 | Williams | 428/929 |
| 2,547,947 | 4/1951 | Kleis | 428/929 |
| 2,568,242 | 9/1951 | Matteson | 200/268 |
| 2,688,574 | 9/1954 | Reed | 428/929 |
| 3,139,669 | 7/1964 | Gwyn | 29/879 |
| 3,346,951 | 10/1967 | Gwyn | 200/267 |
| 3,402,276 | 9/1968 | Scott | 200/268 |
| 3,562,467 | 2/1971 | Mooradian | 200/268 |
| 3,641,298 | 2/1972 | Broverman | 200/267 |

FOREIGN PATENT DOCUMENTS

| | | | |
|---|---|---|---|
| 103244 | 2/1938 | Australia | 428/929 |
| 213123 | 1/1957 | Australia | 200/267 |

OTHER PUBLICATIONS

Gibson, H. B., "Coatings for Electrical Connections", Product Engineering, Nov. 1956, pp. 191–193.

*Primary Examiner*—John Zimmerman

*Attorney, Agent, or Firm*—Shlesinger Fitzsimmons Shlesinger

[57] ABSTRACT

A bimetallic or trimetallic electrical contact, only its shank portion being made of copper or copper alloy and being covered by a thin layer of silver or silver alloy for protecting the shank portion from environmental erosion. Said shank portion is preferably made by cutting silver-plated wire to a short piece.

1 Claim, 1 Drawing Sheet

COMPOSITE ELECTRICAL CONTACT

BACKGROUND OF THE INVENTION

A composite electrical contact such as a rivet-shaped bimetallic contact which is composed of a metallic contact or head portion and a shank portion made of a metal different from the metal of the contact portion and bonded to a bottom surface of the contact portion, is used by fixing it to a support plate by clinching a free end of the copper or copper alloy shank portion against the support plate. The composite electrical contact such as a bimetallic or trimetallic electrical contact thus caulked to a hole of the support base plate is mounted in an electrical appliance for making various electrical control operations such as opening and closing electric circuits.

The contact or head portion of the composite electrical contact of the kind mentioned above is generally made of a silver alloy, in silver matrices of which particles of metal oxides such as tin oxides are precipitated, so that it can stand up well to a high temperature caused by electric arcs generated about the contact portion when the contact is switched on and off.

The shank portion bonded to a bottom surface of such thermal resistant head portion is made of a metal having a high electric conductivity such as copper and copper alloys, so that electric currents can flow efficiently to and from the head portion. The shank portion can contribute also to dissipate the heat generated at the head portion, and is easy to be caulked to a support plate which is also made of copper or copper alloys.

After the shank portion is passed through a hole provided to the support plate and having a diameter nearly equal to the diameter of the shank portion, its free end is clinched and caulked to the support plate.

This caulking is not so easy if it has to ensure hermetical bonding completely between the shank portion and the support plate. That is, it is nearly impossible to bond them completely airtightly so that there will be not left any gap between the circumference of the shank portion and the hole and between the clinched free end of the shank portion and the support plate.

When the contact caulked to the support plate is operated, its temperature rises, especially at the gap. And, when the shank portion of the contact is subjected to air at an elevated temperature, copper of the shank portion exposed to the gap between it and the support plate becomes oxidized in a short period of time. The electrical conductivity of the shank portion which forms green rust on account of oxidation lowers, and the electrical conductivity and heat dissipation characteristics of the contact as a whole lower consequently, resulting in that the temperature of the contact rises rapidly and the contact will be welded.

In view of the above, this invention is to provide a novel composite electrical contact, shank portion of which shall be free from a green rust when it is caulked to a support plate and even when subjected to a severe switching operation.

BRIEF SUMMARY OF THE INVENTION

In this invention, only the shank portion of the composite contact, which is made of copper or copper alloys, is covered by a thin layer of silver or silver alloys.

Composite contacts are often stored in the air for a comparatively long period of time until they are mounted to electrical appliances after they are manufactured. In such case, the contacts, especially copper shank portions become oxidized noticeably. In order to prevent such oxidation, only the shanks of the contacts are silver plated as contrasted with prior contacts which as a whole are dipped into a bath of molten silver so that the entire outer surfaces of the contacts are plated by silver. This latter way of plating results, however, in covering not only the shank portions but also the contact portions. When the contact portions which are made of a high refractory material, are covered by silver, their refractoriness in lost. The contact portions will be welded soon.

DETAILED DESCRIPTION OF THE INVENTION

Example

A wire of 2.5 mm in diameter made of Ag-Sn 8%-In 4%-Ni 0.1% alloy which had been internal-oxidized, was cut to form a short piece. This short piece was employed as noted hereinafter for making the contact or head portion 1 of the contact shown in FIG. 1.

On the other hand, to prepare the shank portion 2, a wire of a pure copper surrounded at its outer circumferential surface by a silver layer 3 which had been plated at a thickness of 70 $\mu$, was employed. This plated wire was hot-rolled to have a diameter of 2.5 mm, including thin layer 3, and was sheared or cut to form a short piece of the type shown in FIG. 2.

Figure 1:
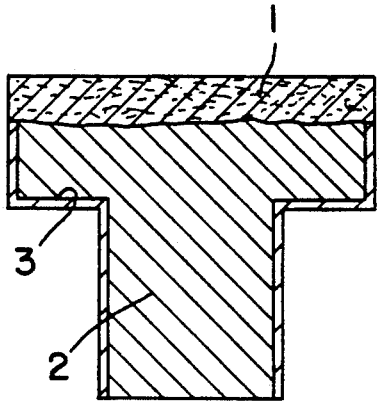
FIG. 1 is an enlarged cross-sectional view of the bimetallic electrical contact made in accordance with this invention.

Said silver-tin internal-oxidized alloy cut wire, and said silver plated copper cut wire (FIG. 2) were aligned coaxially and cold bonded under pressure, immediately after they were cut on sheared to form the cut wires. The two cut wires thus bonded together were shaped to a rivet-shaped bimetallic electrical contact having a configuration and dimensions as shown in FIG. 1. This contact (FIG. 1) is called hereinafter the Contact (A).

Figure 2:
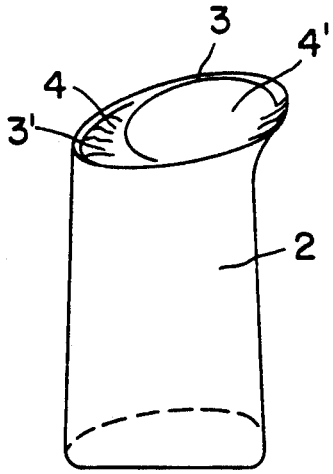
FIG. 2 is an explanatory perspective view showing a short copper wire piece with a circumferential thin plated layer of silver, which will be a shank portion when it is bonded to a contact portion, the wire piece having been sheared to have a fresh and active surface to be bonded to the contact portion.

As shown in FIG. 2, before being cold bonded to the silver-tin oxide cut wire, the upper surface of the silver plated short wire 2 had, as shown in FIG. 2, a cut or sheared surface 4 and a fractured surface 4'. And, onto the cut surface 4 a part 3' of the circumferential silver layer 3. This appears to have flowed silver portion 3' increased the activity of the cut surface 4 for bonding the two cut wires.

For the sake of comparison with the Contact (A), a Contact (B) was made by employing a copper cut wire (without the plated silver layer 3) as its shank portion. A third contact (C) was made by dipping a Contact (B) type into a molten silver bath. This Contact (C) thus had both its contact and shank portions completely plated by silver of 7 $\mu$ in thickness.

The Contacts (A), (B), and (C) were respectively rivetted to copper support plates. Under the following conditions, their initial contact resistances were tested by a ASTM-50 testing machine as shown in the Table 1, while temperatures of them measured at terminals with the support plates after 1,000 switching on and off were as shown in the Tables 2.

Conditions for Initial Contact Resistance:
Contact force 400 g; Electric current DC6V, 1A
Conditions for Temperature Raise:
Load AC200V, 50A;
Reactor pf=0.23; Frequency 60 switching/minute

TABLE 1

| | initial contact resistance (mΩ) |
|---|---|
| Contact (A) | 0.8-2.1 |
| Contact (B) | 1.2-2.3 |
| Contact (C) | 0.7-2.1 |

TABLE 2

| | Temperature (°C.) |
|---|---|
| Contact (A) | 25.6 |
| Contact (B) | 44.3 |
| Contact (C) | testing was stopped as the contact was welded. |

As shown in the above test results, the contact made in accordance with this invention is excellent in that its temperature after a number of switching operations is extremely low showing that its shank portion had not suffered from oxidized erosion and subsequent increase of electrical resistance, and that consequently the shank portion had functioned well to dissipate heat from the contact portion to the support plate.

In this invention, since the shank portion is made of a short wire cut from a copper wire plated at its outer surface with silver, only contacts having only the copper shank portion thereof covered by silver can be made efficiently and economically on an industrial scale.

With respect to physical properties, there are following advantages too, in this invention.

(1) While it is most important in the production of bimetallic contacts to make their bonded surfaces firm and strong, the bonded surfaces which connect the contact and shank portions are most stable and reliable in this invention.

In conventional methods for manufacturing bimetallic contacts by the employment of shank portions which are produced by shearing a copper wire, copper oxides on outer surfaces of the copper wire tend to flow onto sheared surfaces of copper short pieces for the shank portions, resulting in adversely affecting their bonding with the contact portions of silver or silver alloys. Such drawbacks or phenomena are absolutely prevented in this invention, since the copper wires employed are effectively protected at their outer surfaces by silver which prevents inner copper from being oxidized.

(2) Bimetallic contact which have been bonded and shaped by heading to have a desired contact configuration are subjected finally to a cleaning step in which the contacts are forced to abut and polish each other in a rotating barrel, whereby their contact portions are rubbed by copper of the shank portions, and whereby their contact surfaces are consequently tainted microscopically by copper debris.

The bimetallic contact made in accordance with this invention is almost free from such phenomena, because as mentioned above, their copper shank portions are covered by silver.

(3) In case of conventional bimetallic contacts, copper will adhere onto contact surfaces and spoil them, as the contact surface of a contact will inevitably come into abutment with the copper shank portion of another contact when they are stored in bulk or when they are fed successively in bulk for automatically rivetting them to contact supporting plates. Copper particles or debris adhered or sticked to the contact surfaces are oxidized by electric arcs or ageing, resulting in raising contact resistances or inducing weldings.

With respect to electrical properties too, there are following advantages in this invention.

(1) As the test results show, the contacts made in accordance with this invention has a low electrical resistance and a low temperature raise.

The above advantageous features can hardly be expected of conventional bimetallic composite contacts having exposed copper shank portions, because the copper shank portions are equivalently provided with filmy oxidized surfaces in a thickness the order of Angström (Å) even when they are thoroughly cleaned. Such filmy oxidized surfaces make a composite resistance unstable and much different, depending on how much degree the copper shank portions are rivetted to the supporting plates. On the other hand, in this contact, its resistance is extremely stable as mentioned above, on account of its copper shank portions covered with filmy silver which prevents the shank portions from being oxidized. While it is known that copper is oxidized very rapidly when it is heated to above 80° C., such adverse oxidation is avoided in this contact, primarily because its copper portion does not expose outside and additionally because its temperature rising is low.

(2) The bimetallic contacts made in accordance with this invention have small contact consumption and excellent anti-welding characteristics.

The above features are prerequisite to electrical contacts. It can safely be said that those not having these features would not be worth as electrical contacts. One of factors for achieving the above features is to provide contacts with good electrical as well as thermal conductivities, while they will be also dependent on materials of which the contacts are made.

The contact of this invention is well provided with excellent electrical and thermal conductivities. That is, the excellent conductivities are attained by silver films which cover a shank portion of the contact and through which heat produced at a contact portion is effectively transferred to and dispersed in a supporting plate, whereby temperature rising is suppressed low.

(3) Anti-corrosion characteristics are also excellent in this invention.

Especially when contacts are used in a direct current circuit, their switching operations often produce an acid gas by their electrolytic reactions with the moisture of the air.

On account of such gas, copper shank portions easily gather rust which will cause, when grown more, a corrosion and malfunction of the contacts. The contact made in accordance with this invention is free from such corrosion and malfunction, since its shank protion is protected by silver.

It will be noted that although an original silver layer plated over the shank portion was 70 μ in thickness in the example, the thickness could be a few μ or less in accordance with the application and environment for and in which the contact is employed.

And, said silver layer could be replaced by one made of Al, Ni, Pb, Zn, Sn, Ti, Pt, Pd, Rh, V, Ru, or their alloys. And, the shank portion could be made of copper alloys. And, although in the example, a bimetallic contact is described, a trimetallic contact can be made also in accordance with this invention.

We claim:

1. A composite electrical contact, including a head portion of a silver alloy and a shank portion of copper or copper alloy juxtaposed to said head portion, said head portion having at one end thereof a substantially flat surface confronting directly on said shank portion, and having on its opposite end a contact surface, said shank portion comprising a short piece of wire cut at opposite ends thereof from a copper or copper alloy wire coated with a thin layer of silver, whereby opposite ends of said piece of wire are substantially flat and said copper or copper alloy is exposed at each end of said piece of wire, and one of the substantially flat exposed ends of said piece of wire being only circumferentially overlapped by a sheared portion of said silver layer, and being substantially coextensive with and directly cold bonded to said substantially flat surface on said one end of said head portion, whereby only the surface of said shank portion between opposite ends thereof is completely coated with said layer of silver.

* * * * *